United States Patent [19]

Brawner et al.

[11] Patent Number: 4,774,736

[45] Date of Patent: Oct. 4, 1988

[54] TOOL KIT FOR SKATEBOARDERS

[76] Inventors: William H. Brawner, 1130 Pioneer Way, El Cajon, Calif. 92020; Walter H. Tiedge, 9500 Harritt Rd. #144, Lakeside, Calif. 92040

[21] Appl. No.: 20,667

[22] Filed: Mar. 2, 1987

[51] Int. Cl.[4] ..... B25B 13/00

[52] U.S. Cl. ..... 7/138; 81/437; 81/124.4; 7/165

[58] Field of Search ..... 81/437, 124.3, 124.4, 81/177.4, 177.5, 177.85, 489, 490; 7/138, 165, 167, 170; 224/253

[56] References Cited

U.S. PATENT DOCUMENTS

| | | | |
|---|---|---|---|
| 1,677,473 | 1/1927 | Gast | 7/138 |
| 1,968,767 | 2/1934 | Howard | 224/253 |
| 3,877,327 | 4/1975 | Erm | 81/124.4 |
| 4,125,913 | 11/1970 | Lewis | 7/165 |

FOREIGN PATENT DOCUMENTS 0569859 6/1945 United Kingdom .

*Primary Examiner*—Frederick R. Schmidt
*Assistant Examiner*—Lawrence Cruz
*Attorney, Agent, or Firm*—Ralph S. Branscomb

[57] ABSTRACT

A tool kit has two parts which interfit together and are held together inside a generally flexible case, which is designed to be entrained on the belt of a skateboa9rder. One of the two parts defines three different-sized sockets for mounting and removing wheels and tightening the truck attachments to the main board, and the second part mounts an allen wrench and a pair of screwdriver heads, one being a Phillips and the other conventional. The screwdriver heads and allen wrench are used for tightening the rails and other miscellaneous fasteners that may occur on different types of skateboards.

5 Claims, 1 Drawing Sheet

TOOL KIT FOR SKATEBOARDERS

BACKGROUND OF THE INVENTION

In the last couple of decades, the popularity of skateboarding has ebbed and flowed. One of the first peaks in popularity was sparked by the advent of urethane wheels which were relatively frictionless and very quiet, smooth to ride, and provided an excellent frictional surface on pavement.

Since that surge in popularity, the popularity dwindled for a time, and is now back at a peak. Once again, the peak is caused, at least in part, by technological improvements. As with most sports equipment, as the sport ages, the equipment becomes more and more sophisticated.

Currently, in addition to there being a variety of different wheels, boards themselves, rails, truck guards, "copers," frictional coverings, and other decals, stickers, and accessories, there are a variety of different trucks. The trucks are the metal axle portions of the skateboard which mount the wheels and cause the skateboard to steer to the left or right when the appropriate pressure is applied to the top of the board. Although there are a number of truck manufacturers, there are also a number of different types of trucks that are to be used for different skateboarding conditions. Especially in competition, there will often be one truck that is particularly adapted to a certain riding mode, such as in swimming pool bowls, or pipe lengths, that would not be suitable for other courses. This is due in part to the tightness or softness of the truck pivoting assembly, the size of the truck, the turning radius, et cetera.

Trucks also generally have a tightness adjustment so that the same truck can be tightened up to require more turning force. For this reason, the same trucks can be used to cover a range of skateboarding conditions.

However, despite the fact that trucks are generally adjustable, a competition rider may have as many as five or six truck sets that he will switch on and off of his board during the course of the several different types of events in a typical skateboarding competition. Additionally, he would be typically periodically adjusting the tension on the truck that is mounted on his board, and also checking the rails and other parts to ensure that all other screws and bolts are tight. Because of the rigor of the sport, it is not uncommon that nuts and bolts may loosen during use.

For these reasons, skateboarders will generally carry certain tools in their pockets to accomodate the different adjustments and the changing of the trucks, and the checking of the various parts for tightness of nuts and bolts. However, should one or more of the tools fall out of the skateboarder's pocket, or if he should leave it lying around, and find himself in a position without tools, either his outing or his competition could be severely jeopardized. Additionally, carrying loose tools in the pocket can be somewhat dangerous because of the hard falls at strange angles that skateboarders are prone to take, particularly when skating around the rims and bowls at a skateboard park. There is a need for a tool kit which is complete, in that it will handle all skateboard adjustment and changing functions, and yet be secure to the skateboarder and maintained safely out of the way while skateboarding.

SUMMARY OF THE INVENTION

The instant invention acknowledges the above-stated need and provides a specialized tool kit which is carried in a flexible case on the user's belt, or on his shoe, or in any other convenient place. The kit includes two generally T-shaped parts, which have stems which interfit, with the first part having three sockets defined at the respective ends of the tee, and the second part having an allen wrench and two screwdriver heads at the respective end of the tee. The allen wrench portion of the second part fits within one of the sockets of the first part, so that an I-shaped unit is created, and this unit is held together inside the flexible plastic case, which is adapted to be mounted to the skateboarder's belt or to his shoe, et cetera.

The tool has been designed such that the three different sizes of sockets, the Phillips head screwdriver, the flat head screwdriver, and the Allen wrench provide all of the tools the skateboarder needs to work on his board.

DETAILED DESCRIPTION OF THE PREFERRED EMBODIMENT

Figure 1:
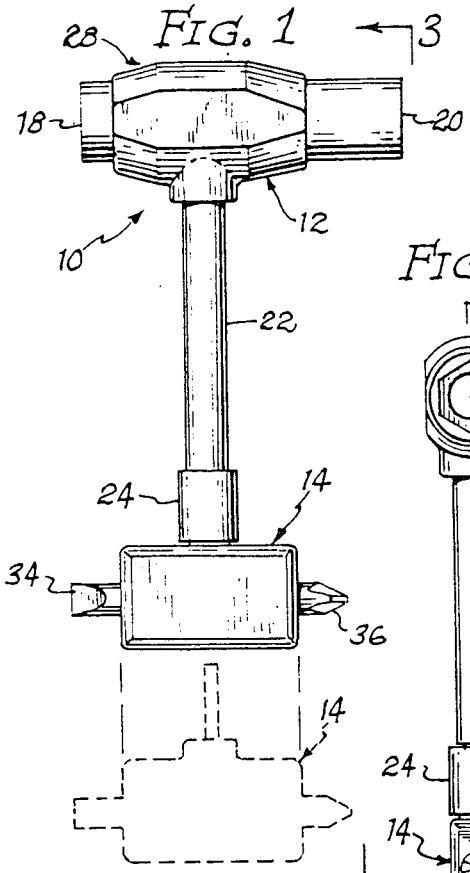
FIG. 1 is a side elevation view of the invention showing the second tool member exploded from its interfitting relation with the first tool member, in phantom.
Figure 2:
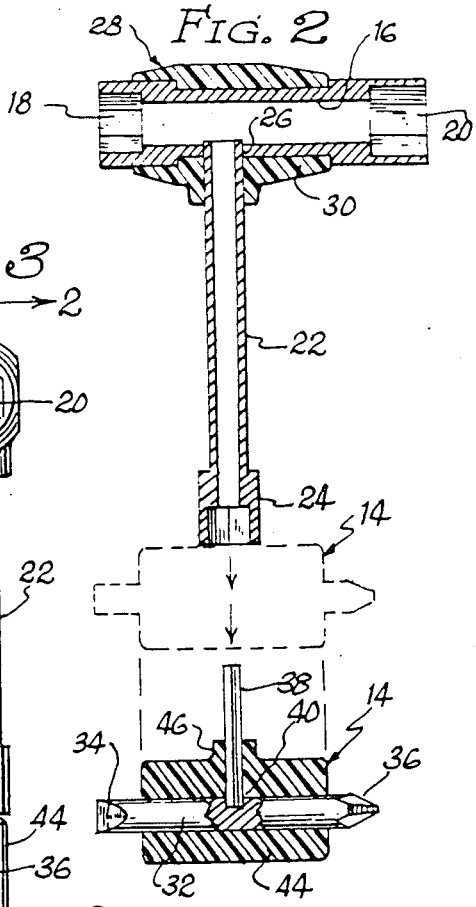
FIG. 2 is a section taken longitudinally through the tool, with the sectioned second portion being exploded from the tool unit.
Figure 3:
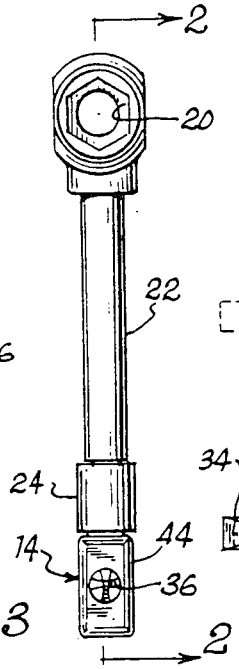
FIG. 3 is an elevation view taken along line 3—3 of FIG. 1.

The tool unit is shown in FIG. 1, having a first tool member 12 and a second tool member 14. The individual tool members are both basically T-shaped, as can best be seen from FIGS. 1 or 2. The first tool member has a hollow, transverse socket mounting bar 14, which defines sockets 18 and 20 on its respective ends. These sockets are of different sizes to accomodate nuts and bolts of different sizes, and of course are tailored to the sizes of nuts and bolts that are commonly used on skateboards.

The stem 24 of the generally T-shaped first tool member also defines a socket 24 at its end. The stem is welded or braized at 26 to the transverse bar 16 of the first tool member, and the central body portion 28 of the first tool member is encased in high-impact plastic 30, for the protection of the unit and the reinforcement of the connection of the stem and rest of the body, as well as for aesthetics.

The second tool member 14 has a transverse shaft 32, but rather than defining sockets, the ends of this shaft define conventional and Phillips screwdriver heads 34 and 36, respectively. An allen wrench 38 is welded or braized at 40 and to the side of the transverse shaft and defines the stem of the tee. The Allen wrench inserts inside the hollow shaft 22 when the tools fit together as a unit.

The central body portion 42 of the second tool member is also encased in high-impact plastic 44. In addition to the general considerations of strengthening the tool, making it easier to use, and improving the aesthetics, the plastic portion of the second tool member has a boss 46, which will fit within the socket 24 at the end of the stem 22 of the first tool member. This boss is preferably dimensioned so that it fits rather snugly into the socket, so that the two tool members are truly a single unit, at least until pulled apart. The way in which the second tool member interfits with the first is best seen by the phantom designation in FIG. 2, wherein the allen wrench 38 fits within the shaft 22 and the boss 46 fits within the socket 24. It is, however, not necessary that the boss fit snugly. The mere extension of the Allen wrench within the stem 22 will align the tool parts and hold them together.

Figure 4:
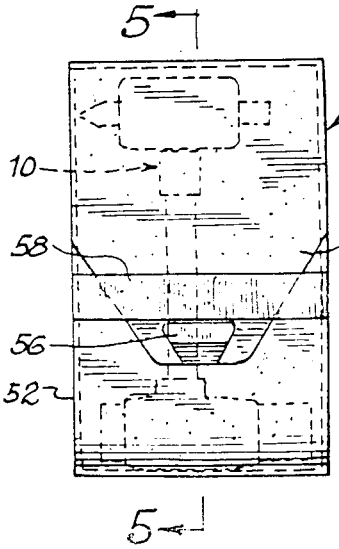
FIG. 4 is a front elevation view of the case of the kit showing the tool unit inside in phantom.
Figure 5:
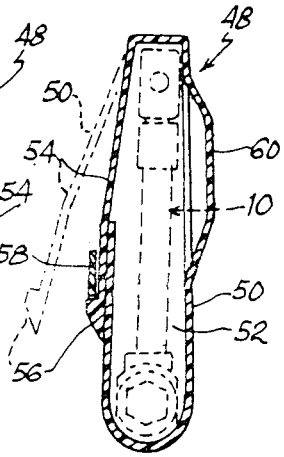
FIG. 5 is a section taken along line 5—5 of FIG. 4, illustrating the tool unit within the tool case.

The tool has a case 48 which also serves to hold the first and second tool members together as a single tool unit, as shown in FIG. 4. The tool members cannot separate when inside the case. The tool case is preferably a flexible plastic case having a principal panel which wraps from the front around the bottom of the tool, up around the back and back down across the front again, as best seen in FIG. 5. The sides are interfitting panels 52 which are stitched or preferably heat sealed to the main flap to hold its shape, except for the front flap 54, which opens to expose the tool kit.

The front flap 54 has a raised lip 56 which slips beneath the band 58 which is also stitched or heat sealed to the front portion of the main panel, as shown in FIG. 5. When the flap 54 is inserted beneath the band 58, the lip 56 will hold the case closed until the user depresses it against the body of the case to free it from beneath the band 58 to open the tool kit.

Figure 6:
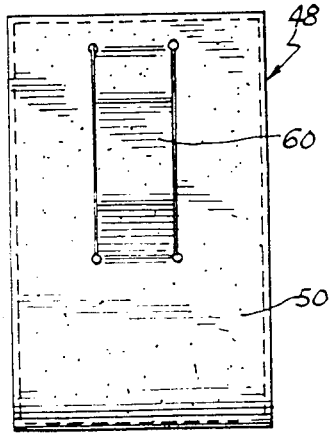
FIG. 6 is a rear elevation view of the tool kit inside its case, illustrating its belt loop.

As can be seen from FIGS. 4 and 5, because of the dimensioning of the tool case, there is no possibility that the individual tool members will separate while inside the case. There is also additional room within the case to permit the user to carry cash, credit cards, identification, keys and other small items. This is one reason that the unit is not molded to exactly fit the contours of the tool. Because often skateboarders will be very lightly clothed, they may be wearing shorts with no pockets or very shallow pockets, or otherwise have no place to safely keep such small items, especially in view of the acrobatics. The instant tool case, on the other hand, is slit at the rear to define a belt loop 60 shown in FIGS. 5 and 6. The belt loop can be engaged in a belt, if the user is wearing a belt, and if not, it can be laced into the shoelaces of the user's shoes. It would thus be rare indeed to find a skateboarder who did not either have a belt, laced shoes, or even Velcro straps on his shoes, to use to engage the belt loop 60 of the tool kit case so that it would be positively secured and not subject to flying off the body of the user while skateboarding. The closure comprised of the raised lip 54 and the band 58 are sufficiently positive that there is no chance that the tool kit would open during normal use, no matter how creative and acrobatic the exercises of the user.

By carrying one of these tool kits, the skateboarder is secure in the knowledge that at all times he will have whatever tools he needs to tighten the parts on his board, remove and replace trucks, tighten the trucks, adjust the trucks, tighten the wheels, remove and replace the wheels, and in short, do everything necessary on site in the way of making tool-made adjustments to his board. The specific socket sizes, and the selection of components that have been included in the kit, including the two different scewdriver heads and the allen key, have been carefully thought out while considering the form of all popular skateboards, so that every tool is available to the user by virture of carrying the single kit. In the unusual circumstance that an off-sized allen wrench would be useful, there is room within the case to contain a spare allen wrench. Additionally, although all common socket sizes are included, it would be possible to carry an additional socket, which could be adapted to fit within one of the socket openings present in the first tool member.

There are an estimated ten million skateboarders in the United States. Currently, these skateboarders carry a potpourri of tools, wads of dollar bills, and some kind of identification, and maybe a key or two in their pockets. These are constantly being lost, and the skateboarders are constantly being frustrated. Once the avid skateboarder has acquired the instant kit, however, such frustration and problems will come to an end. There will be no normal circumstance in which loose nuts or screws, or maladjusted truck tension will not be correctable on the spot in just a few minutes by the very simple expedient of carrying the highly specialized and virtually universally applicable tool kit described and claimed herein.

I claim:

1. A skateboard tool kit comprising:

(a) a first tool member defining three tools;

(b) a second tool member defining three tools;

(c) said members being generally T-shaped and having interfitting means for fitting the tool members together for transport and storage;

(d) said first generally T-shaped tool member having a first stem portion defining one of said three tools of first tool member and the second generally T-shaped tool member having a second stem portion defining one of said three tools of second tool member, and said first stem portion being hollow at least in part and receiving said second stem portion such that said stem portions together define said interfitting means; and, (e) said first and second tool members being generally planar and when interfitted are generally co-planar, and including a case dimensioned to encase said first and second tool members and hold same together in co-planar interfitted relation.

2. A skateboard tool kit according the claim 1 wherein said second tool member defines three male tools.

3. A skateboard tool kit according the claim 2 wherein said second tool member has two laterally extended screwdriver tips and said second stem is an allen wrench.

4. A skateboard tool kit according the claim 1 wherein said first generally T-shaped tool member defines a pair of laterally directed sockets in addition to said first stem portion, and said first stem portion is the hollow stem portion and is also a socket, such that said first generally T-shaped tool member defines three extended sockets.

5. A skateboard tool kit according the claim 1 wherein each of said tool members has a central body portion encased in plastic with flattened parallel sides to allow said tool members to lie in a more narrowly defined plane, and to strengthen said tool members and enhance the gripability thereof.

* * * * *